US007273346B2

(12) United States Patent
Bouru

(10) Patent No.: US 7,273,346 B2
(45) Date of Patent: Sep. 25, 2007

(54) SYSTEM FOR CONTROLLING STAGES OF VARIABLE-PITCH STATOR VANES IN A TURBOMACHINE

(75) Inventor: Michel Andre Bouru, Montereau sur le Jard (FR)

(73) Assignee: SNECMA, Paris (FR)

( * ) Notice: Subject to any disclaimer, the term of this patent is extended or adjusted under 35 U.S.C. 154(b) by 0 days.

(21) Appl. No.: 11/383,277

(22) Filed: May 15, 2006

(65) Prior Publication Data

US 2006/0260307 A1 Nov. 23, 2006

(30) Foreign Application Priority Data

May 17, 2005 (FR) ..... 05 04916

(51) Int. Cl.
*F01D 9/04* (2006.01)

(52) U.S. Cl. ..... 415/162

(58) Field of Classification Search ..... 415/160, 415/162

See application file for complete search history.

(56) References Cited

U.S. PATENT DOCUMENTS 3,146,585 A * 9/1964 Gulick ..... 60/230
3,779,665 A * 12/1973 Tatem et al. ..... 415/123
4,295,784 A * 10/1981 Manning ..... 415/162
4,400,135 A 8/1983 Thebert

FOREIGN PATENT DOCUMENTS

| | | |
|---|---|---|
| EP | 0 909 880 A2 | 4/1999 |
| FR | 2 856 424 | 12/2004 |
| GB | 857800 | 1/1961 |

OTHER PUBLICATIONS

U.S. Appl. No. 11/383,277, filed May 15, 2006, Bouru.
U.S. Appl. No. 11/383,287, filed May 15, 2006, Bouru.

* cited by examiner

*Primary Examiner*—Ninh H. Nguyen
(74) *Attorney, Agent, or Firm*—Oblon, Spivak, McClelland, Maier & Neustadt, P.C.

(57) ABSTRACT

A system for controlling two stages of variable-pitch stator vanes of a turbomachine, the system comprising a drive element for turning the control ring of one of the stages via a leader member pivotally mounted on the casing, a synchronization bar for transmitting the turning movement of the ring driven by the drive element to the control ring of the other stage via a follower member pivotally mounted on the casing, and an additional pivot member interposed between the follower member and the follower ring, said additional pivot member being pivotally mounted on the follower member and being connected to the casing by a wheel sliding in a slot secured to the casing.

5 Claims, 4 Drawing Sheets

SYSTEM FOR CONTROLLING STAGES OF VARIABLE-PITCH STATOR VANES IN A TURBOMACHINE

BACKGROUND OF THE INVENTION

The present invention relates to the general field of controlling stages of variable-pitch vanes in a turbomachine.

In a turbomachine, it is known to use one or more stages of stator vanes for adjusting the flow direction and rate of gas passing through the compression section as a function of the operating speed of the turbomachine. Each such stator vane stage comprises a plurality of vanes (known as variable-pitch vanes) that can pivot about their respective pins connecting them to the stator, so that their pitch angle can be modified as a function of the operating speed of the turbomachine.

Known devices for controlling a stage of variable-pitch vanes generally comprise a control member in the form of a ring surrounding the casing of the turbomachine, and a plurality of links or levers, with each link having a first end connected to the control ring via a hinge and a second end mounted on the pivot of a respective vane. A drive actuator is connected to the control ring in order to turn it about the axis of the turbomachine. When the ring turns about the turbomachine axis it causes all of the vanes of the stage to change their angular position synchronously.

When two axially-offset stages of variable-pitch vanes are to be controlled in synchronous manner, it is also known to make use of a synchronization bar to transmit the turning movement from the ring that is driven by the drive actuator to the control ring of the other stage. This transmission of movement takes place via bell cranks pivotally mounted on the casing of the turbomachine and connected firstly to the synchronization bar and secondly to respective ones of the control rings.

That control system generates movements in the various controlled stages that can be represented in the form of curves plotting the pitch angle of the vanes in the follower stage as a function of the pitch angle of the vanes in the leader stage. With a control system of the above-described type, such a curve, referred to as a "correlation" curve, can present a slope that varies, but only progressively. Thus, that type of control system can be used to command vane stages in simple manner only.

However, it is becoming and more frequent for the aerodynamic requirements on controlling vane pitch require control relationships to be more complex. Such controls lead to correlation curves in which variation is no longer merely with a slope that is progressive, but also includes curved portions that are similar in shape to sinewaves.

Document EP 0 909 880 describes a variable-pitch device making it possible to obtain non-linear control relationships. In that device, each link of the leader stage is connected to the corresponding control ring via a connection having a groove and a stud sliding in the groove. Nevertheless, that control system is not satisfactory since it does not make it possible to reproduce any kind of control relationship.

OBJECT AND SUMMARY OF THE INVENTION

A main object of the present invention is thus to mitigate those drawbacks by proposing a control system that makes it possible to implement any type of vane pitch relationship, regardless of its complexity.

To this end, the invention provides a system for controlling two stages of variable-pitch stator vanes in a turbomachine, each stage being made of a plurality of vanes each pivotally mounted on a casing of the turbomachine, and a control ring surrounding the casing and connected to each of the vanes of the stage via respective levers, the control system including a drive element for turning the control ring of one of the stages via a leader member pivotally mounted on the casing, and a synchronization bar for transmitting the turning movement of the ring driven by the drive element to the control ring of the other stage via a follower member pivotally mounted on the casing, the system further comprising an additional pivot member interposed between the follower member and the follower ring, said additional pivot member being pivotally mounted on the follower member and being connected to the casing by a wheel sliding in a slot secured to the casing.

The term "follower ring" is used to mean the control ring that is turned under drive from the follower member.

In an advantageous disposition of the invention, the slot presents a shape and a direction that are determined so as to compensate for path differences between a desired pitch relationship and a nominal pitch relationship. The term "nominal pitch relationship" is used to cover a pitch relationship in which the correlation curve of progressive slope is obtained by a conventional control system that does not include an additional pivot member.

The additional pivot member constitutes a differential guide element that takes account only of the path differences relative to the nominal pitch relationship. In other words, the wheel in the system of the invention needs only to accommodate the difference that exists between the desired pitch relationship and the nominal pitch relationship. As a result, the control system makes it possible to obtain vane pitch relationships that cannot be obtained using conventional control systems.

According to another advantageous provision of the invention, the additional pivot member has a first arm connected to the follower ring via a first control rod, and a second arm connected to the casing via said wheel.

According to yet another advantageous provision, the follower member has a first arm pivotally connected to the additional pivot member and a second arm connected to one end of the synchronization bar. In which configuration, the leader member has a first arm connected to the ring of the leader stage via a second control rod, a second arm connected to the end of the synchronization bar that is opposite from its end connected to the follower member, and a third arm connected to the drive element.

BRIEF DESCRIPTION OF THE DRAWINGS

Other characteristics and advantages of the present invention appear from the following description given with reference to the accompanying drawings that show an embodiment without any limiting character. In the figures.

DETAILED DESCRIPTION OF AN EMBODIMENT

Figure 1:
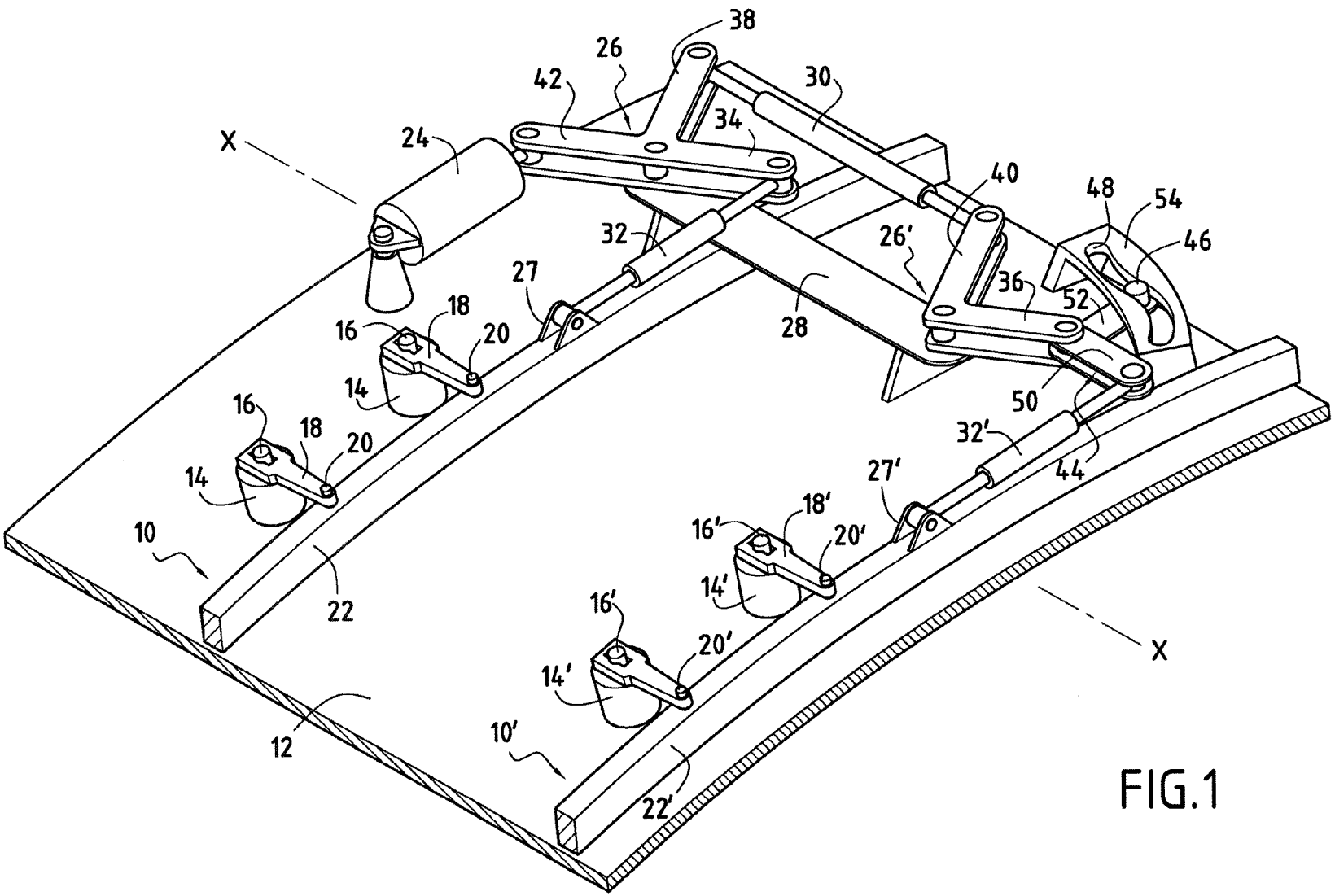
FIG. 1 is a fragmentary perspective view of the control system in an embodiment of the invention.

FIG. 1 shows part of two stages 10, 10' of variable-pitch vanes belonging to a turbomachine compressor, for example. The compressor comprises an annular stator casing 12 (or shroud) centered on the axis X-X of the turbomachine. The stages 10, 10' of vanes are axially offset relative to each other.

Each stage comprises a plurality of vanes 14, 14' disposed radially about the axis X-X of the turbomachine. The vanes 14, 14, are mounted to pivot about respective pins 16, 16' (or pivots) that pass through the casing 12.

Each pin 16, 16' of a variable-pitch vane 14, 14' is connected to one end of a control lever or link 18, 18' whose other end is hinged about a pin 20, 20' projecting radially from a control ring 22, 22'.

The control rings surround the casing 12 and are centered on the axis X-X of the turbomachine. The angular position of the vanes 14, 14' is thus modified in synchronized manner by turning the respective control regions 22, 22' about the axis X-X of the turbomachine.

The system of the invention serves to control the turning of the control rings 22 and 22' about the axis X-X of the turbomachine in synchronized manner. It comprises an actuator type drive element 24 secured to the casing 12 to turn the control ring 22 of one of the stages 10 via a leader member 26 of the bell-crank type which is pivotally mounted on a support 28 on the turbomachine casing 12.

A synchronization bar 30 serves to transmit the turning movement of the ring 22 as driven by the actuator 24 (referred to as the leader ring) to the ring 22' of the other stage 10' (referred to as the follower ring) via a follower member 26' of the bell-crank type which is likewise pivotally mounted on the support 28 of the casing 12.

Control rods 32, 32' of the turnbuckle type serve to transmit the movement from the driver crank 26 and the follower crank 26' to the ring 22, 22'. These rods extend tangentially to the rings to which they are secured via connecting forks 27, 27'. At their opposite ends, the rods 32, 32' are secured to respective arms (or branches) 34, 36 of the leader crank 26 and the follower crank 26', being hinged thereto.

The synchronization bar 30 of the control system unites two other respective arms 38, 40 of the leader crank 26 and the follower crank 26', being hinged thereto. The actuator 24 is hinged to a third arm 42 of the leader crank 26 opposite from the arm 34 to which the rod 32 is secured.

The control system of the invention also includes an additional pivot member 44 (or additional crank) which is interposed between the follower member 26' and the follower ring 22'. The additional crank is pivotally mounted on the follower crank 26' and is connected to the casing 12 by a wheel 46 that slides in a slot 48 secured to the casing.

More precisely, the additional crank 44 has a first arm 50 with one end connected to the control rod 22' for the follower ring 22' by being hinged thereto and with its other end pivotally mounted on the follower member 26'. The additional crank also has a second arm 52 with one end pivotally mounted on the follower member 26' and with its opposite end fitted with the wheel 46. The first and second arms 50 and 52 of the additional crank are stationary relative to each other. In other words, the angle between these two arms 50 and 52 is constant and unvarying. The wheel 46 slides in a slot 48 following a predetermined path in a support 54 that is secured on the casing 12 of the turbomachine.

Figure 2A:
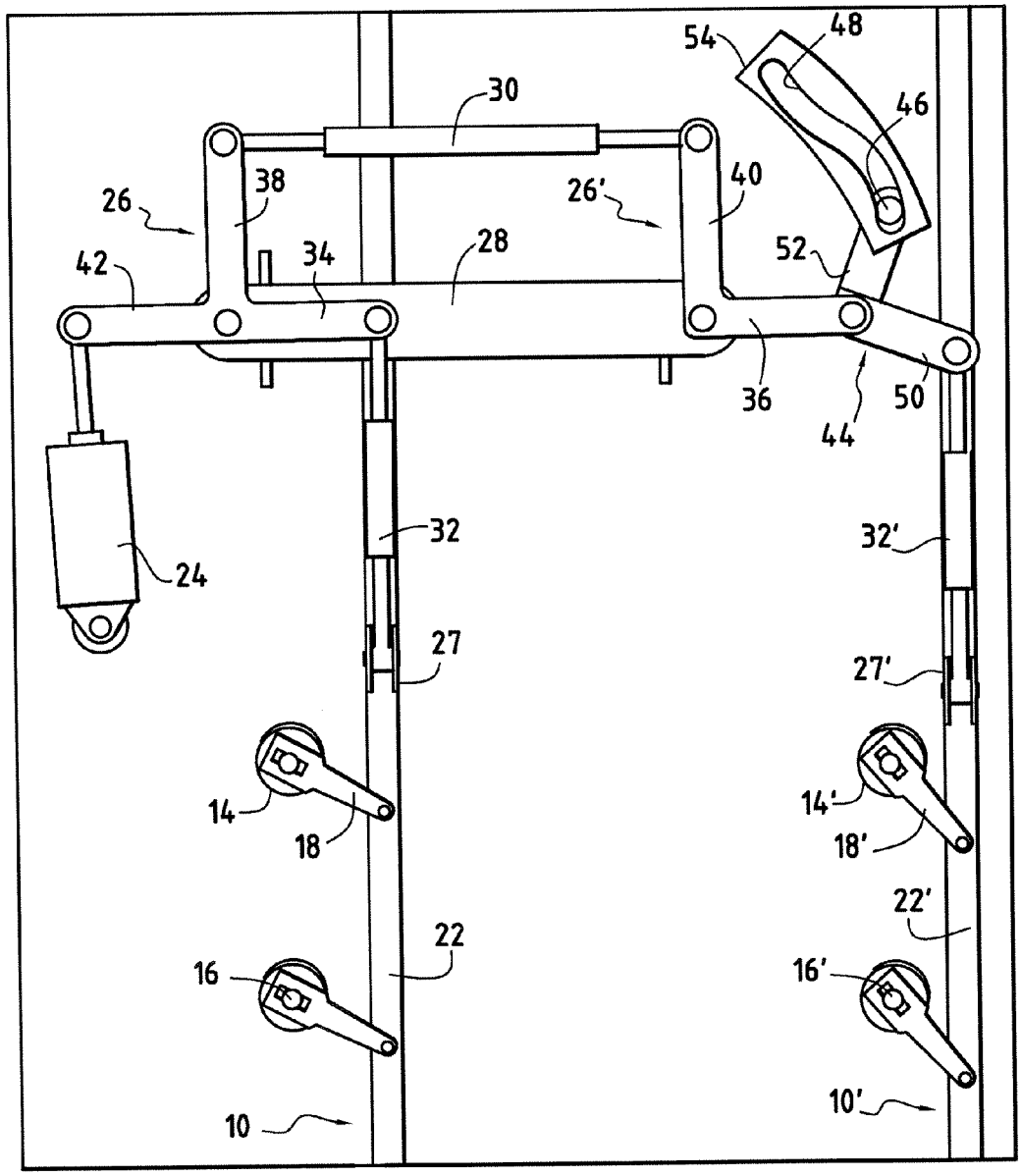
FIGS. 2A and 2B show the FIG. 1 control system in two different positions.
Figure 2B:
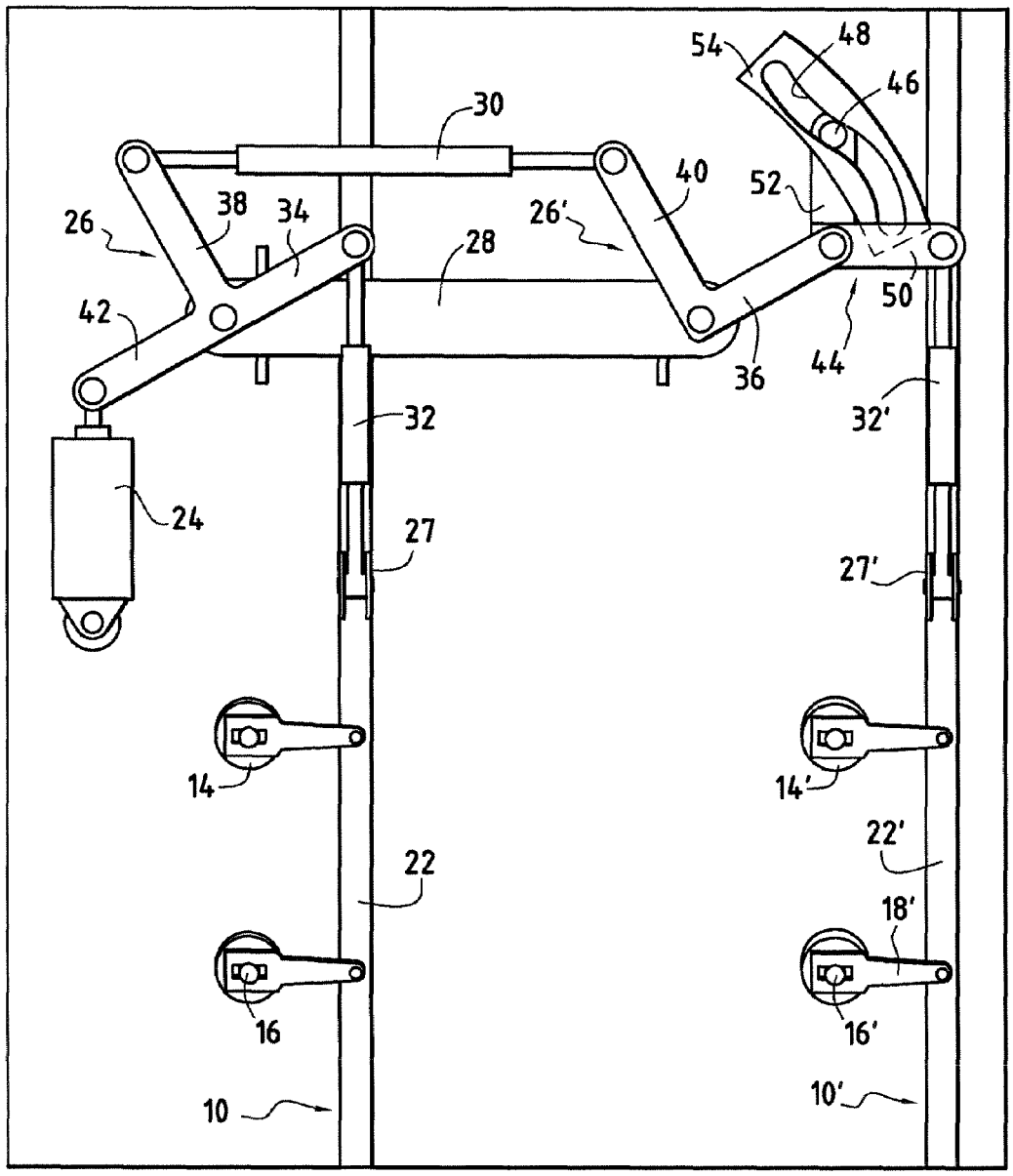

As shown in FIGS. 2A and 2B, the control system moves as follows: actuating the actuator 34 causes the leader crank 26 to turn, thus causing the follower crank 26, to turn via the synchronization bar 30. When the cranks 26 and 26' turn about their respective pivot points on the casing 12, they in turn drive the respective rods 32 and 32' which then cause the rings 22 and 22' to turn in one direction or the other about the axis X-X of the turbomachine. As mentioned above, turning the rings causes the angular position of the vanes 14, 14' in each stage 10, 10' to be changed in synchronized manner via the control levers 18, 18'.

Furthermore, the turning of the follower crank 26' leads to the additional crank 44 turning about its own pivot axis on the follower crank. This has the effect of causing the wheel 46 to slide in the slot 48, thus moving the arm 52 of the additional crank 44 on which the wheel is mounted. This movement then moves the other arm 50 of the additional crank to which the rod 32' is connected.

It can thus be understood that the path determined by the slot 48 in which the wheel 46 slides determines the displacement of the follower ring 22', and thus the pitch relationship for the vanes 14' of the follower stage 10'. In other words, the shape and the direction of the slot modify the pitch relationship of the vanes in the follower stage, and thus the correlation curve plotting the pitch angle of the vanes 14' of the follower stage 10' as a function of the pitch angle of the vanes 14 of the leader stage 10.

Figure 3:
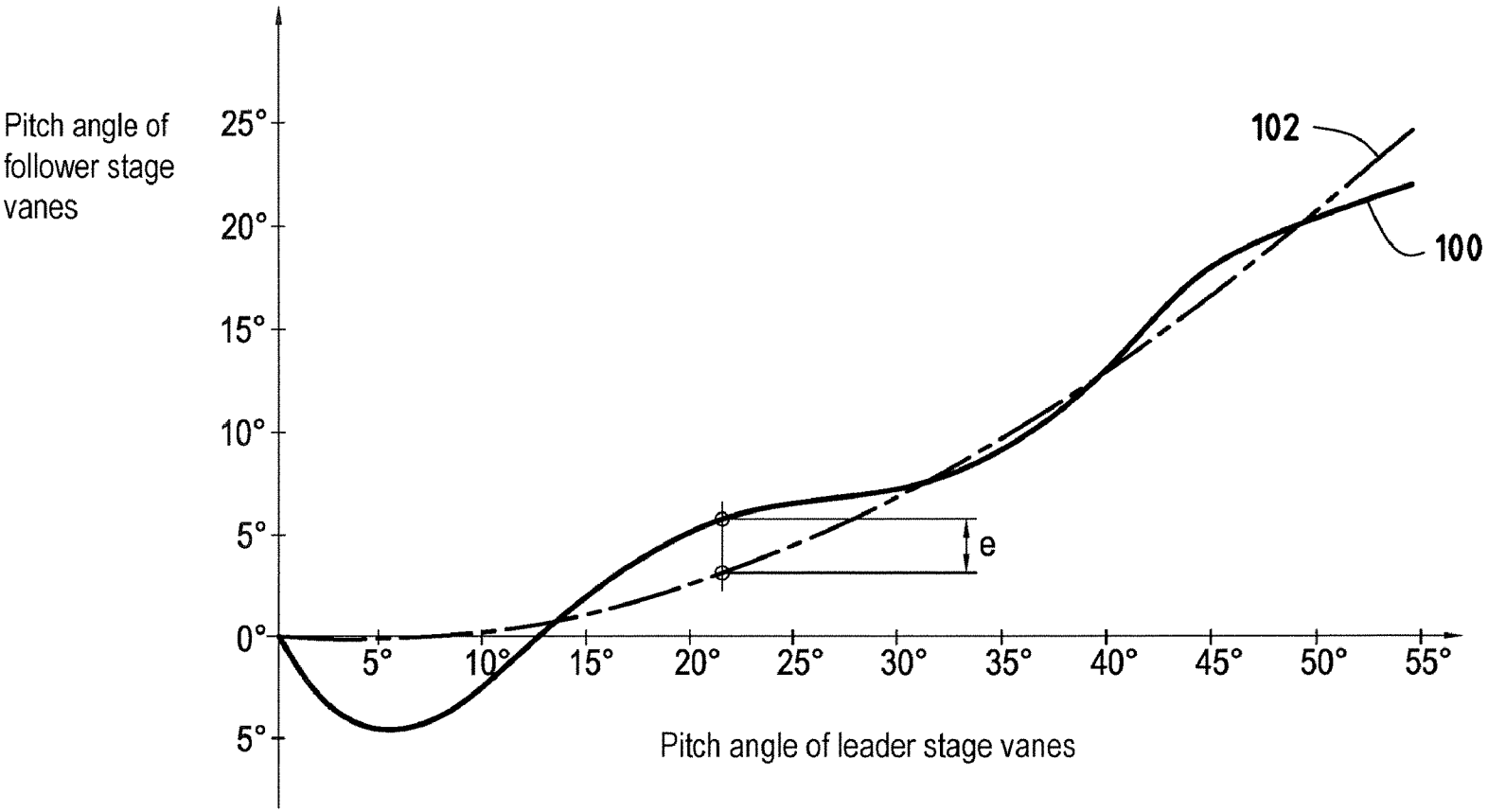
FIG. 3 is a correlation curve showing one possible pitch relationship obtained by the control system of the invention.

With reference to FIG. 3, there follows a description of how the shape and the direction of the slot 48 are predetermined. This figure shows correlation curves 100 and 102, i.e. curves plotting the pitch angle of the vanes 14' of the follower stage 10' (in degrees) as a function of the pitch angle of the vanes 14 of the leader stage 10 (in degrees).

The correlation curve 100 (continuous lines) is the curve that ought to be applied to the pitch of the vanes in these two stages in order to satisfy aerodynamic requirements. This curve is complex; in particular, it includes curved portions similar in shape to sinewaves.

Starting from this correlation curve, it is possible to select a nominal correlation curve 102 (chain-dotted line) having a progressive slope and that comes as close as possible to the correlation curve 100 that ought to be applied. The pitch relationship based on such a nominal curve can easily be obtained using a known control system of the prior art having follower and leader cranks and a synchronization bar interconnecting the cranks, and in which the control rod of the follower ring is connected directly to one of the arms of the follower crank. As a function of the relative position of the leader and follower cranks, that type of control system gives known pitch relationships in which the correlation curves are more or less progressive (sometimes linear). Amongst those known nominal curves, the curve that is closest is selected merely by calculating averages (graphically or numerically), and the curve that has the smallest differences relative to the curve that ought to be applied over the entire angular range is considered as being the closest curve.

The shape and the direction of the slot for the additional crank are then calculated as a function of the differences e that exist over the entire angular range between the correlation curve 100 that is to be applied and the nominal correlation curve 102, so that the wheel compensates for these differences. This calculation can be performed by a method that is graphical or numerical. It should be observed that a slot having a simple circularly-arcuate shape corresponds to the correlation curve for application coinciding with the selected nominal correlation curve.

Preferably, the shape and the direction of the slot for the additional crank are such as to ensure that the wheel carried by the additional crank does not lie on a circular arc so as to avoid any unstable position for the wheel, and thus for the pitch of the vanes.

The control system of the invention thus includes a differential guide element that takes account only of the path differences between the correlation curve to be applied and a nominal correlation curve. This makes it easy to reproduce any type of pitch relationship, regardless of its complexity. The advantage of the invention lies in particular in the fact that no attempt is made to obtain a correlation curve by making direct use of guidance by means of a cam, but instead by making use of a wheel that reproduces only path differences relative to a nominal correlation curve.

It should be observed that the invention can also be implemented for controlling some number of vane stages that is greater than two by using as many synchronization bars as are appropriate. Depending on the dispositions that are selected, the bars may either be successive, i.e. interconnecting adjacent cranks, or mutually parallel so as to extend to a common crank.

What is claimed is:

1. A control system for controlling two stages of variable-pitch stator vanes in a turbomachine, each stage including a plurality of vanes each pivotally mounted on a casing of the turbomachine, and a control ring for each stage surrounding the casing and connected to each of the vanes of the stage via respective levers, the control system including a drive element for turning a first control ring of one of the stages via a leader member pivotally mounted on the casing, and a synchronization bar for transmitting the turning movement of the first control ring driven by the drive element to a second control ring of the other stage via a follower member pivotally mounted on the casing, the system further comprising an additional pivot member interposed between the follower member and the second control ring, said additional pivot member being pivotally mounted on the follower member and being connected to the casing by a wheel sliding in a slot secured to the casing.

2. A control system according to claim 1, in which the slot presents a shape and a direction that are determined so as to compensate for path differences between a desired pitch relationship and a nominal pitch relationship.

3. A control system according to claim 1, in which the additional pivot member has a first arm connected to the second control ring via a first control rod, and a second arm connected to the casing via said wheel.

4. A control system according to claim 1, in which the follower member has a first arm pivotally connected to the additional pivot member and a second arm connected to one end of the synchronization bar.

5. A control system according to claim 4, in which the leader member has a first arm connected to the first control ring via a second control rod, a second arm connected to the end of the synchronization bar that is opposite from its end connected to the follower member, and a third arm connected to the drive element.

* * * * *